US008371204B2

(12) United States Patent
Elder et al.

(10) Patent No.: US 8,371,204 B2
(45) Date of Patent: Feb. 12, 2013

(54) BUBBLE WEAPON SYSTEM AND METHODS FOR INHIBITING MOVEMENT AND DISRUPTING OPERATIONS OF VESSELS

(75) Inventors: Steven J. Elder, Tucson, AZ (US); James H. Dupont, Bowie, AZ (US)

(73) Assignee: Raytheon Company, Waltham, MA (US)

( * ) Notice: Subject to any disclaimer, the term of this patent is extended or adjusted under 35 U.S.C. 154(b) by 237 days.

(21) Appl. No.: 12/770,890

(22) Filed: Apr. 30, 2010

(65) Prior Publication Data

US 2012/0042954 A1 Feb. 23, 2012

(51) Int. Cl.
*F41F 3/10* (2006.01)

(52) U.S. Cl. ..... 89/5; 114/20.1; 42/1.14; 102/399

(58) Field of Classification Search ..... 89/5, 1.1, 89/1.11; 42/1.14; 102/293, 399; 114/20.1, 114/382, 316, 317
See application file for complete search history.

(56) References Cited

U.S. PATENT DOCUMENTS

| | | | | |
|---|---|---|---|---|
| 923,922 | A | 6/1909 | Wratzke | |
| 1,222,498 | A | 4/1917 | Steinmetz | |
| 1,947,407 | A | 2/1934 | Cornell, Jr. | |
| 2,289,318 | A | 7/1942 | Pratt | |
| 2,334,211 | A | 11/1943 | Miller | |
| 2,466,561 | A | 4/1949 | Standal | |
| 2,557,815 | A | 6/1951 | Wheel Wright et al. | |
| 2,693,078 | A | 11/1954 | Laucher | |
| 2,713,308 | A | 7/1955 | Brown et al. | |
| 2,779,281 | A | 1/1957 | Maurice et al. | |
| 2,954,750 | A | 10/1960 | Crump et al. | |
| 2,995,088 | A | 8/1961 | Asplund | |
| 3,109,373 | A | 11/1963 | Saffer et al. | |
| 3,316,840 | A | 5/1967 | Grand | |
| 3,358,884 | A | 12/1967 | Link | |
| 3,372,996 | A * | 3/1968 | Barrett et al. | 422/129 |
| 3,417,719 | A | 12/1968 | Nitenson | |
| 3,902,425 | A | 9/1975 | Kurtzemann | |
| 2,745,369 | A | 5/1976 | Brown et al. | |
| 4,047,668 | A | 9/1977 | Deweese et al. | |
| 4,069,021 | A | 1/1978 | Schneider | |
| 4,092,943 | A | 6/1978 | Lund et al. | |
| 4,188,884 | A | 2/1980 | White et al. | |
| 4,249,673 | A | 2/1981 | Katoh et al. | |
| 5,069,109 | A * | 12/1991 | Lavan, Jr. | 89/1.11 |
| 5,654,523 | A | 8/1997 | Brunn | |
| 6,145,459 | A | 11/2000 | Takahashi et al. | |
| 6,164,565 | A | 12/2000 | Adee et al. | |
| 6,186,085 | B1 | 2/2001 | Kato et al. | |
| 6,581,521 | B1 | 6/2003 | Dixon et al. | |
| 6,655,313 | B1 | 12/2003 | Woodall et al. | |

(Continued)

OTHER PUBLICATIONS

"U.S. Appl. No. 12/362,547, Advisory Action mailed Jan. 4, 2010", 2 pgs.

(Continued)

*Primary Examiner* — Benjamin P Lee
(74) *Attorney, Agent, or Firm* — Schwegman Lundberg & Woessner, P.A.

(57) ABSTRACT

Embodiments of a bubble weapon system and methods for inhibiting movement and disrupting operations of vessels are generally described herein. In some embodiments, a bubble weapon is configured to generate a plume of bubbles in water. The plume reduces buoyancy of the water to inhibit movement of a vessel or disrupt operations of the vessel. In some embodiments, the bubble weapon includes a configurable diffuser section that may be configured in a thrust-neutral configuration or a thrust-engaged configuration.

25 Claims, 15 Drawing Sheets

U.S. PATENT DOCUMENTS

| | | | |
|---|---|---|---|
| 6,701,819 | B1 | 3/2004 | Williams et al. |
| 6,899,290 | B2 | 5/2005 | Varble et al. |
| 6,938,840 | B1 | 9/2005 | Trutschel et al. |
| 6,962,121 | B1 | 11/2005 | Kuklinski |
| 7,059,544 | B2 | 6/2006 | Leonard et al. |
| 7,067,732 | B1 | 6/2006 | Kuklinski |
| 7,185,588 | B2 | 3/2007 | Clark et al. |
| 7,730,838 | B1 | 6/2010 | Dupont et al. |
| 7,789,009 | B1 | 9/2010 | Brittingham |
| 7,895,948 | B2 | 3/2011 | Dupont et al. |
| 2002/0139287 | A1 | 10/2002 | Chase |
| 2004/0200374 | A1 | 10/2004 | Sansolo |
| 2005/0047870 | A1 | 3/2005 | Rode |
| 2010/0192798 | A1 | 8/2010 | Dupont et al. |
| 2012/0103424 | A1 | 5/2012 | Dupont et al. |

OTHER PUBLICATIONS

"U.S. Appl. No. 12/362,547, Final Office Action mailed Oct. 29, 2009", 6 pgs.

"U.S. Appl. No. 12/362,547, Non-Final Office Action mailed Jul. 9, 2009", 11 pgs.

"U.S. Appl. No. 12/362,547, Response filed Jan. 8, 2010 to Adivosry Action mailed Apr. 4, 2010", 7 pgs.

"U.S. Appl. No. 12/362,547, Response filed Dec. 17, 2009 to Final Office Action mailed Oct. 29, 2009", 11 pgs.

"U.S. Appl. No. 12/362,547, Response to Non Final Office Action mailed Jul. 9, 2009", 12 pgs.

"U.S. Appl. No. 12/698,611, Non-Final Office Action mailed Jun. 18, 2010", 8 Pgs.

"U.S. Appl. No. 12/698,611, Response filed Sep. 15, 2010 to Non Final Office Action mailed Jun. 18, 2010", 7 pgs.

"U.S. Appl. No. 12/362,547, Notice of Allowance mailed Jan. 28, 2010.", 4 Pgs.

"U.S. Appl. No. 12/698,611 Notice of Allowance mailed Oct. 29, 2010", 4 Pgs.

U.S. Appl. No. 12/770,879, filed Apr. 30, 2010, Vortice Amplified Diffuser for Buoyancy Dissipater and Method for Selectable Diffusion.

"U.S. Appl. No. 12/770,879, Non Final Office Action mailed Jul. 17, 2012", 11 pgs.

"U.S. Appl. No. 12/770,879, Response filed Oct. 9, 2012 to Non Final Office Action mailed Jul. 17, 2012", 13 pgs.

"U.S. Appl. No. 12/770,879, Notice of Allowance mailed Nov. 26, 2012", 7 pgs.

* cited by examiner

BUBBLE WEAPON

BUBBLE WEAPON SYSTEM AND METHODS FOR INHIBITING MOVEMENT AND DISRUPTING OPERATIONS OF VESSELS

GOVERNMENT RIGHTS

This invention was not made with United States Government support. The United States Government does not have certain rights in this invention.

RELATED APPLICATIONS

This application is related to co-pending patent application entitled "BUOYANCY DISSIPATER AND METHOD TO DETER AN ERRANT VESSEL" filed Jan. 30, 2009 having Ser. No. 12/362,547 which is incorporated herein by reference.

This application is related to co-pending patent application entitled "BUOYANCY DISSIPATER AND METHOD TO DETER AN ERRANT VESSEL" filed Feb. 2, 2010 having Ser. No. 12/698,611 which is incorporated herein by reference.

This application is related to patent application entitled "VORTICE AMPLIFIED DIFFUSER FOR BUOYANCY DISSIPATER AND METHOD FOR SELECTABLE DIFFUSION" filed concurrently herewith and which is incorporated herein by reference.

TECHNICAL FIELD

Embodiments pertain to inhibiting movement of vessels by buoyancy reduction of water. Some embodiments pertain to bubble weapons and systems of bubble weapons. Some embodiments pertain to the use of bubble plumes to inhibit the effectiveness of sonar systems to protect ships from torpedoes and to locate enemy submarines.

BACKGROUND

There are currently general needs to protect ships as well as fixed assets and critical locations, such as dams and harbors, from errant vessels. These needs include the ability to disrupt operations of the errant vessel or inhibit movement of the vessel while ensuring non-lethality.

Thus, there are general needs for inhibiting movement of vessels and weapons configured to inhibit movement of vessels or disrupt operations of vessels. There are also general needs for inhibiting the effectiveness of sonar systems for protecting ships from torpedoes and for locating enemy submarines.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1A:
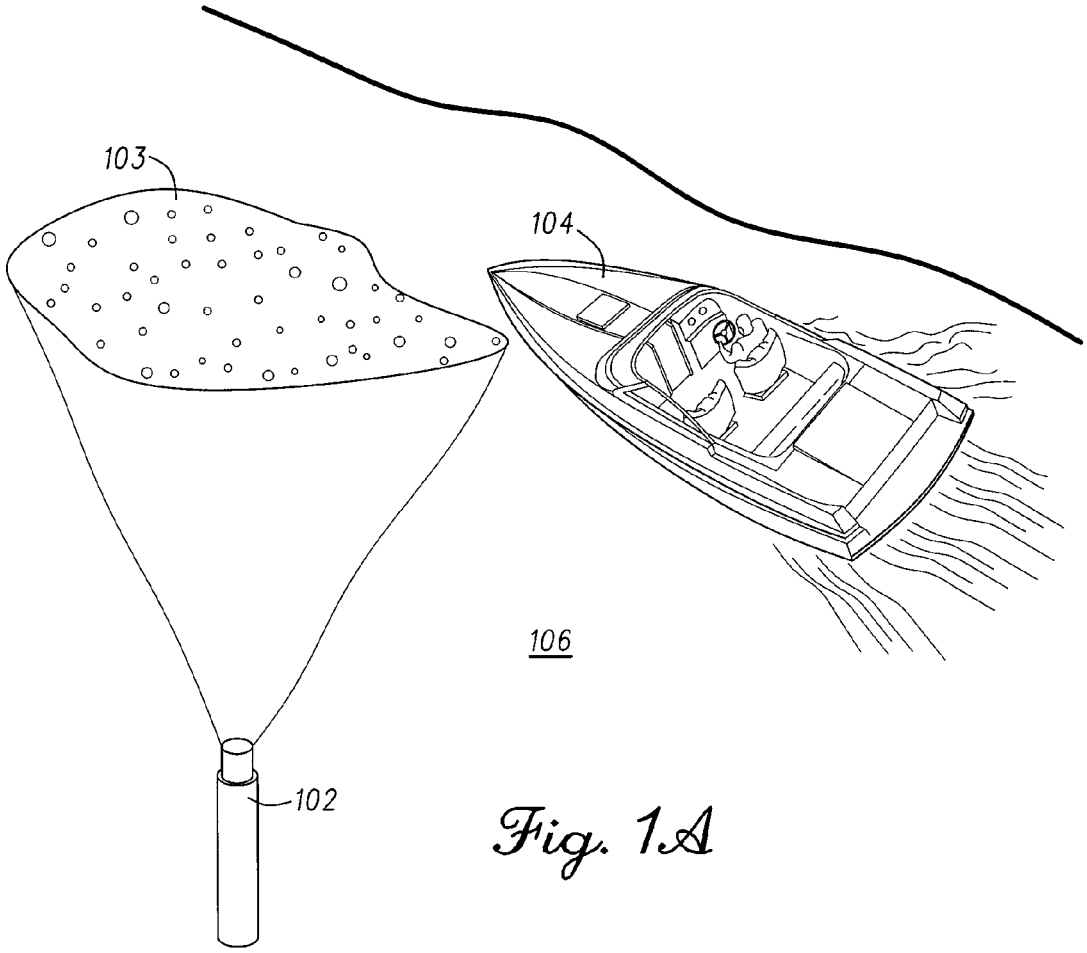
FIGS. 1A and 1B illustrate the operation of a bubble weapon, in accordance with some embodiments.
Figure 1B:
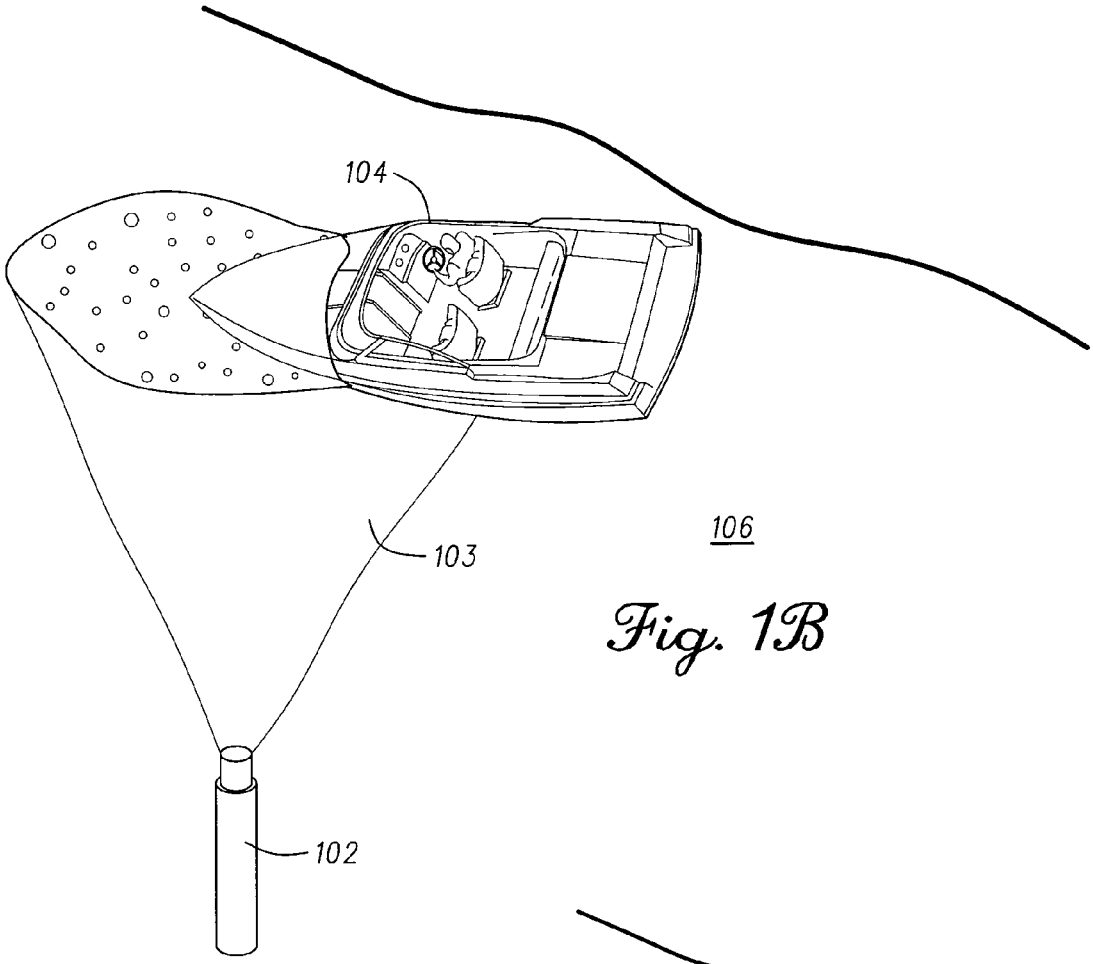

FIGS. 1A and 1B illustrate the operation of a bubble weapon, in accordance with some embodiments. As illustrated in FIG. 1A, a bubble weapon 102 may be configured to generate a plume 103 of bubbles in the water 106. As illustrated in FIG. 1B, the plume 103 reduces the buoyancy of the water 106 to inhibit movement of the vessel 104.

In some embodiments, the bubble weapon may include a diffuser section to generate the plume 103 of bubbles. The diffuser may be a configurable diffuser section. When a configurable diffuser section is used, the configurable diffuser section may be configured in a thrust-neutral configuration to provide neutral thrust. The neutral thrust may offset any thrust generated during the generation of the plume 103, thereby allowing the bubble weapon to remain stationary. In other embodiments, discussed in more detail below, the configurable diffuser section may be configured in a thrust-engaged configuration. When configured in the thrust-engaged configuration, the configurable diffuser section may provide thrust to the bubble weapon to allow the bubble weapon to move through the water.

As illustrated in FIG. 1B, when the vessel 104 hits the reduced buoyancy water, the bow may sink and the forward momentum of the craft will further drive it under and pitch it over. In the case of open cabin craft, this action may eject a person onboard and further drive the craft under. The person may be recovered from the water by rescue crews. If a person lands in water that is bubbleized, the person may not be able to tread water or swim. However, once the bubbles have surfaced, the normal buoyancy of the water is restored. The person will then be able to swim or tread water normally. In a worst case scenario, the person may sink to the bottom of the bubble plume where there is normal buoyancy; however, the person may sink only as deep as the bubble plume. In these embodiments, the depth of the bubble plume may be no more than a few tens of feet, although this is not a requirement. Accordingly, use of the bubble weapon 102 may help ensure non-lethality while inhibiting movement of the vessel 104. These embodiments may apply to both open cabin and closed cabin craft.

Embodiments described herein are not limited to the use of a bubble weapon to generate a bubble plume, but are applicable to the generation of a bubble plume using any pressurized gas source. For example, compressed air may be used. For defense of many stationary targets, a gas can be deployed to a release location via a pipe. For fixed assets, such as dams and harbors, a ground-based compressor and a pipe may also be used. In some embodiments, a ship's onboard compressor can also act as a source of gas to generate a bubble plume.

Figure 2A:
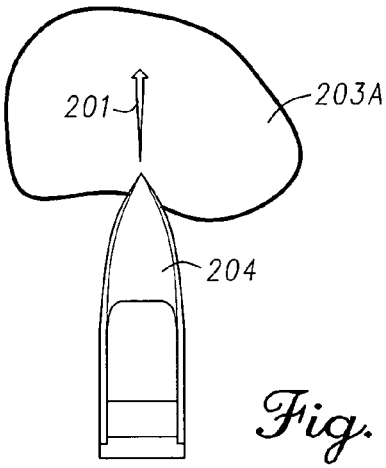
FIG. 2A illustrates the operation of a bubble weapon system configured to generate a large plume asymmetric to a traveling vector of the vessel, in accordance with some embodiments.

FIG. 2A illustrates the operation of a bubble weapon system configured to generate a large plume asymmetric to a traveling vector of the vessel, in accordance with some embodiments. In these embodiments, a bubble weapon, such as bubble weapon 102 (FIGS. 1A and 1B), may be configured to release a large plume 203A asymmetric to a traveling vector 201 of the vessel 204. The large plume 203A may be configured to be greater than half the length of the vessel 204. In some embodiments, a system comprising a plurality of two or more bubble weapons 102 may be configured to release the large plume 203A.

Figure 2B:
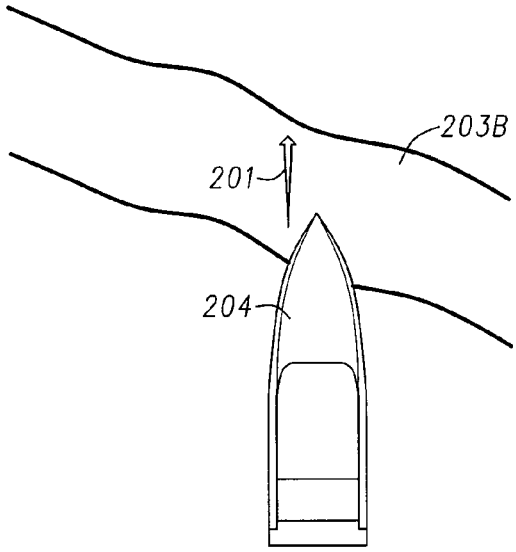
FIG. 2B illustrates the operation of a bubble weapon system configured to generate a ribbon plume that traverses a traveling vector of the vessel, in accordance with some embodiments.

FIG. 2B illustrates the operation of a bubble weapon system configured to generate a ribbon plume that traverses a traveling vector of the vessel, in accordance with some embodiments. In these embodiments, a bubble weapon, such as bubble weapon 102 (FIGS. 1A and 1B), may be configured to generate a ribbon plume 203B that traverses the traveling vector 201 of the vessel 204. The ribbon plume 203B may traverse the traveling vector 201 of the vessel 204 at an angle that ranges between thirty and sixty degrees, and preferably at about forty-five degrees or more. In some embodiments, a system comprising a plurality of two or more bubble weapons 102 may be configured to generate the ribbon plume 203B.

In the embodiments illustrated in FIGS. 2A and 2B, the large plume 203A or the ribbon plume 203B may cause the vessel 204 to capsize as the vessel enters the plume. In these embodiments, a configurable diffuser section may be used and may be configured in the thrust-engaged configuration. In these embodiments, for the vessel 204 to capsize, the vessel's center of mass should extend beyond the center of buoyancy. As the vessel 204 enters the reduced buoyancy water tangentially, the bow of the vessel 204 may start to sink, pitching the vessel 204 downward. Because the vessel 204 is tangential to the reduced buoyancy water, the vessel may list toward the side with reduced buoyancy. The combination of the pitch down and the list may torque the vessel 204 over. The momentum of the vessel 204 may also force water over and plow water over the prow of the vessel. In these embodiments, either large plume 203A or ribbon plume 203B may be generated by a quick release of gas to generate bubbles.

To achieve a tangential collision, the large plume 203A may be released asymmetric to the traveling vector 201 of the vessel 204 and the large plume 203A may be large enough that greater than half of the vessel's length and beam enters the plume. Alternatively, the ribbon plume 203B of bubbles may be configured to transverse the traveling vector 201 of the vessel at an angle. The depth of the bubble plume may also be configured for capsizing the vessel. The submerged portion of the vessel 204 may have buoyancy restored when it leaves or dives beneath the bubble plume. This action will lift the vessel toward the surface.

In some of these embodiments, one or more bubble weapons are configured to selectively submerge either the bow or stern of the vessel. In these embodiments, if the vessel 204 is of significant length, the submerged section of the vessel 204 may be deep enough to be crushed or ruptured when the bubble plume dissipates.

Figure 3:
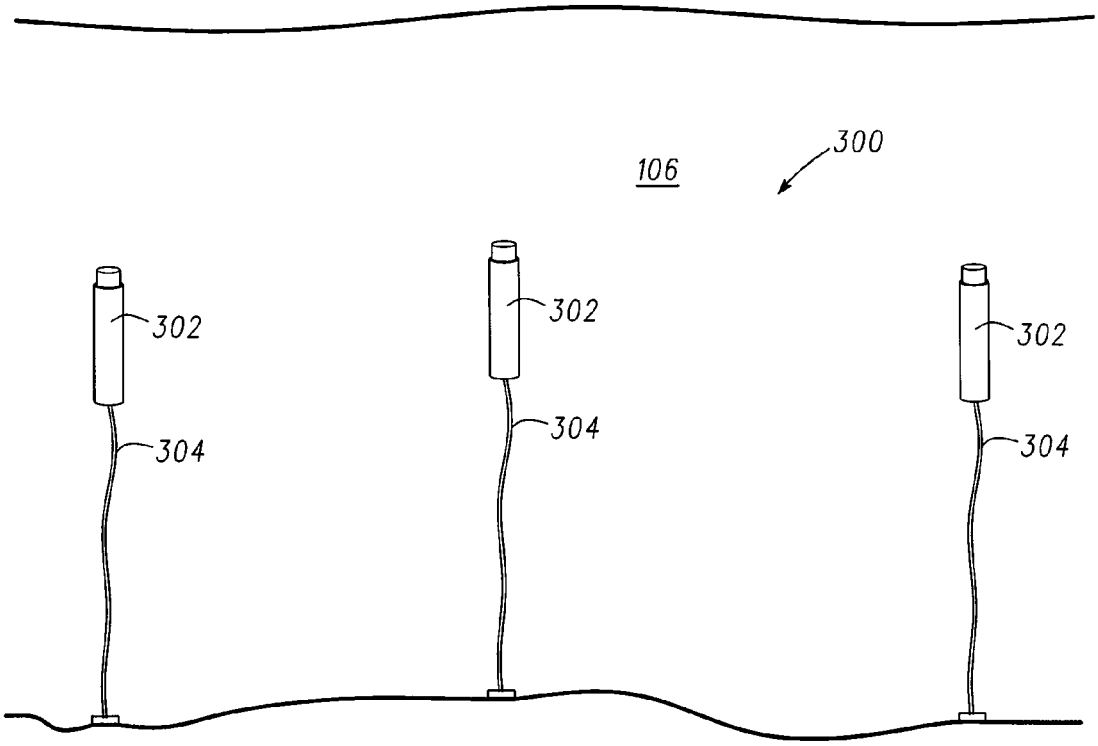
FIG. 3 illustrates a system of bubble weapons configured for fixed asset protection, in accordance with some embodiments.

FIG. 3 illustrates a system of bubble weapons configured for fixed asset protection, in accordance with some embodiments. In these embodiments, a bubble weapon system 300 comprising a plurality of two or more bubble weapons 302 may be configured under water 106 for fixed asset protection. The bubble weapon system 300 may comprise a tethered array of bubble weapons 302 and each bubble weapon may be stationed at a fixed and/or critical location. This may be similar to an array of mines.

In these embodiments, the configurable diffuser section may be configured in the thrust-neutral configuration. In these embodiments, the array of bubble weapons 302 may be configured for protection of fixed assets such as harbors or dams. The location of each of the bubble weapons 302 may be fixed by a tether 304, although this is not a requirement. These embodiments may allow assets such as high traffic areas, harbors and dams to have permanent bubble weapon systems installed on the critical perimeters.

In some embodiments, one or more of the bubble weapons 302 may be discharged under an errant vessel, swamping it in before it crosses a border or into a critical perimeter. To help ensure non-lethality, the bubble weapon system 300 may be operated for two configurations, one configuration for open cabin craft and another configuration for closed cabin craft. For the open cabin craft, the bubble weapons 302 may be used without rigor because swamping a vessel and ejecting the crew by a sudden loss of forward momentum may put the crew in the water and normal buoyancy may return as soon as the bubble plume has passed. For closed cabin craft, asymmetric loading may be used. Embodiments that apply asymmetric loading to vessels are discussed in more detail below.

In some of these embodiments, each of bubble weapons 302 may include a proximity sensor to sense a vessel and discharge under or below the vessel based on the vessel's proximity before the vessel crosses a critical perimeter. In some alternate embodiments, each of bubble weapons 302 may be signaled to discharge by a control signal provided a system controller external to the bubble weapons 302.

Figure 4A:
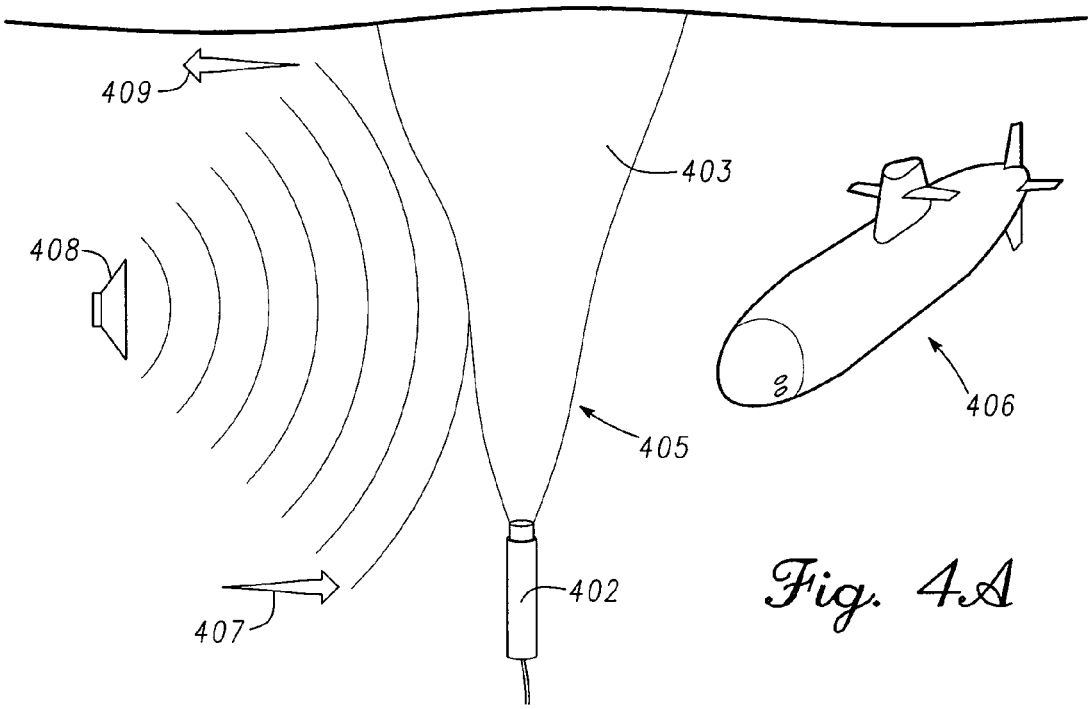
FIGS. 4A, 4B and 4C illustrate the operation of the one or more bubble weapons configured to cause sonar blindness, in accordance with some embodiments.
Figure 4B:
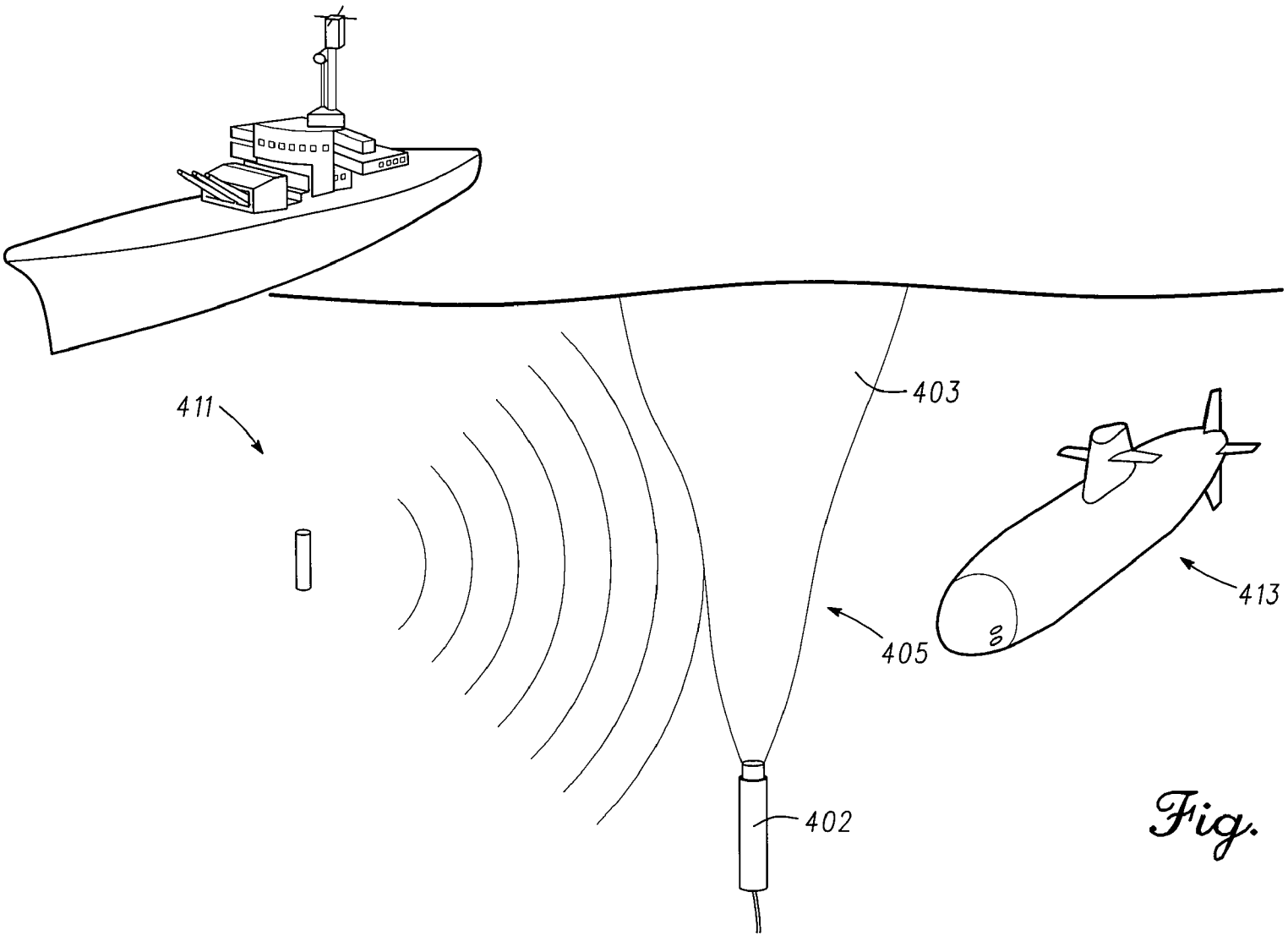
Figure 4C:
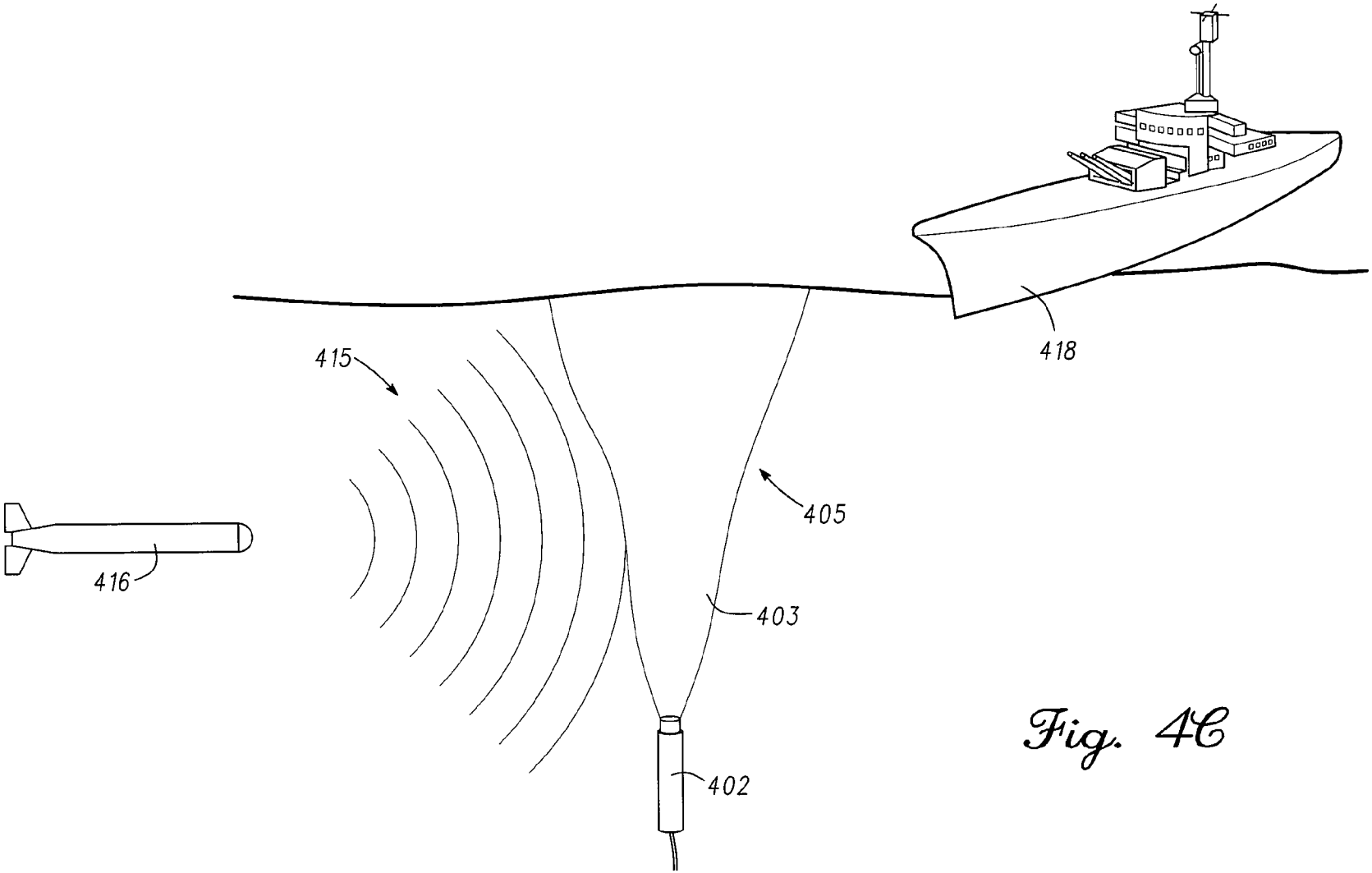

FIGS. 4A, 4B and 4C illustrate the operation of the one or more bubble weapons configured to cause sonar blindness, in accordance with some embodiments. In these embodiments, a bubble weapon system comprising one or more bubble weapons 402 may be configured to generate a sonar and acoustic-opaque barrier 405 to cause sonar blindness. To generate the sonar and acoustic-opaque barrier 405, the one or more bubble weapons 402 may generate a bubble plume 403 by releasing bubbles in a slow manner over a period of time.

In these embodiments, the configurable diffuser section may be configured in either the thrust-engaged configuration or the thrust-neutral configuration depending on the target. As illustrated in FIG. 4A, the sonar and acoustic-opaque barrier 405 may cause an incoming sonar signal 407 from a sonar source 408 to be reflected as a phase-distorted and attenuated return signal 409. In these embodiments, rather than generating a plume of bubbles by a quick release of gas, a slower release of bubbles over time is employed. In these embodiments, the sonar and acoustic-opaque barrier 405 results because of the loss of energy when the sound wave travels between different media. Because the acoustical properties of the bubble plume 403 are vastly different than the acoustical properties of water, sonar energy is reflected by the bubble plume 403. Moreover, the diffuse nature of the bubble plume 403 may disperse and convolute the sonar waves from any vessel.

As illustrated in FIG. 4B, the sonar and acoustic-opaque barrier 405 resulting from the bubble plume 403 may allow naval operations 411 that may be emitting sound to be undetected by an enemy sub 413 or a detector. In these embodiments, sonar and acoustic-opaque barrier 405 generated by one or more bubble weapons 402 may provide a passive sonar curtain.

As illustrated in FIG. 4C, the sonar and acoustic-opaque barrier 405 resulting from the bubble plume 403 may disrupt a guidance sonar signal 415 from an incoming torpedo 416 for protection of a vessel 418. In these embodiments, sonar and acoustic-opaque barrier 405 may be generated by one or more bubble weapons 402.

In the embodiments illustrated in FIGS. 4A-4C, the bubble plume 403 creates the sonar and acoustic-opaque barrier 405, and the reflection and diffusion of a sonar signal may dramatically increase the noise floor, making many sonar systems blind. The white noise emitted from the bubble plume 403 may also increase noise levels. In these embodiments, the configurable diffuser section may be configured in either the thrust-engaged configuration or the thrust-neutral configuration, depending on the target.

Figure 5:
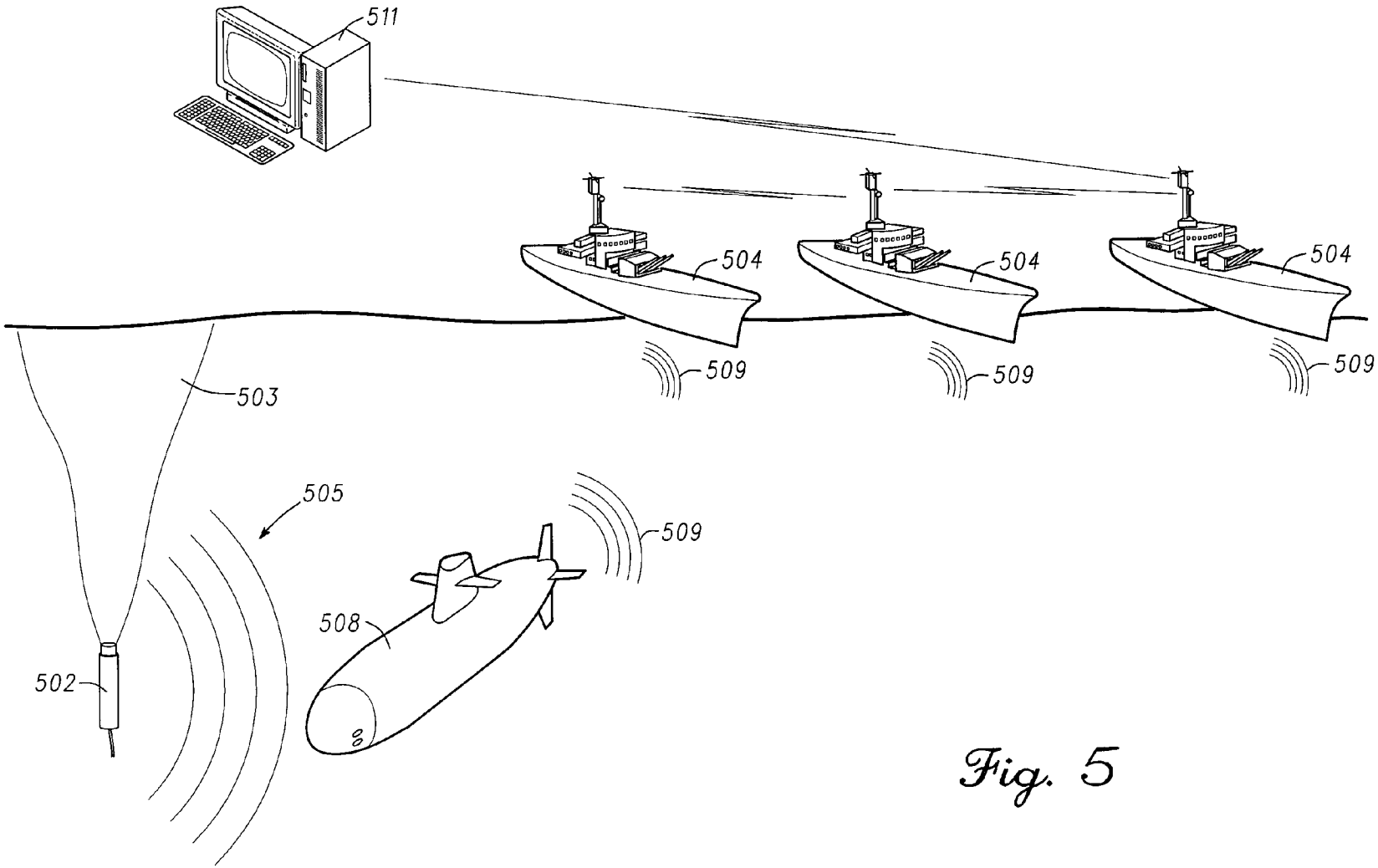
FIG. 5 illustrates the operation of the one or more bubble weapons configured to generate broad-spectrum white noise, in accordance with some embodiments.

FIG. 5 illustrates the operation of the one or more bubble weapons* that are configured to generate broad-spectrum white noise, in accordance with some embodiments. In these embodiments, a bubble weapon system comprising one or more bubble weapons 502 may be configured to generate and emit broad-spectrum white noise 505 by generating a plume 503 of bubbles in water. The system includes one or more processors 511 to process spectral and phase characteristics of sound signals 509 received at one or more vessels 504 (or other receiving locations) to locate an enemy sub 508. The spectral and phase characteristics may include refractive dispersion of the broad-spectrum white noise 505 that may be caused by the enemy sub 508.

In these embodiments, the configurable diffuser section may be configured in either the thrust-engaged configuration or the thrust-neutral configuration, depending on the target. For example, in these embodiments, the location of the enemy sub 508 may be determined from triangulation techniques. The length, breadth, orientation, radius and other information about the enemy sub 508 may be calculated from the refractive dispersion. In these embodiments, the one or more vessels 504 may transmit the received spectral characteristics of sound signals 509 to a central location for processing. In these embodiments, a data analysis for processing the spectral and phase characteristics of sound signals 509 may include performing Doppler shift corrections.

FIGS. 6A-6E illustrate asymmetric loading of a moving vessel by one or more bubble weapons, in accordance with some embodiments. In these embodiments, a system of one or more bubble weapons 602 may be configured for asymmetric loading of a moving vessel 604. The one or more bubble weapons 602 may include a diffuser configurable to create thrust to propel the bubble weapon and configurable to generate a bubble plume 603. The diffuser may be configured to generate the bubble plume 603 below a bow of the moving vessel 604, and configured to propel the bubble weapon 602 while generating the bubble plume 603 to extend the bubble plume 603 in a direction of the moving vessel's momentum. This may cause the moving vessel 604 to pitch and roll over.

In these embodiments, the bubble weapons 602 create thrust by streaming bubbles from a nozzle that is part of the configurable diffuser section. Through the use of thrust, the one or more bubble weapons 602 may be located very accurately and the size of the bubble plume 603 may be controlled. Bubble weapon 602 may place the bubble plume 603 in a location to controllably disperse the buoyancy of the water under the moving vessel 604. In this way, the bow or stern may be selectively sunk. This may cause the moving vessel 604 to pitch down at the bow with a bow plume or pitch up with a stern plume. In these embodiments, the configurable diffuser section may be configured in either the thrust-engaged configuration or the thrust-neutral configuration depending on the target.

Figure 6A:
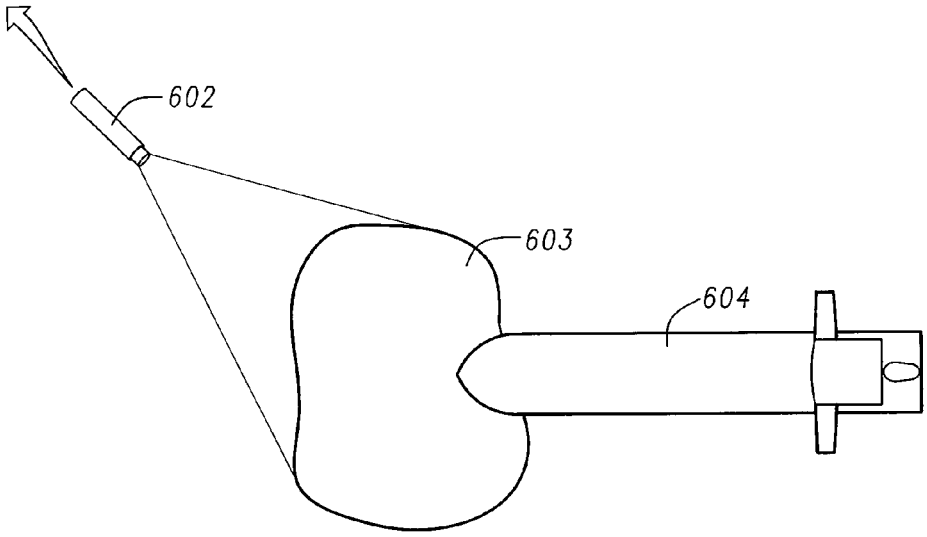
FIGS. 6A-6E illustrate asymmetric loading of a moving vessel by one or more bubble weapons, in accordance with some embodiments.
Figure 6B:
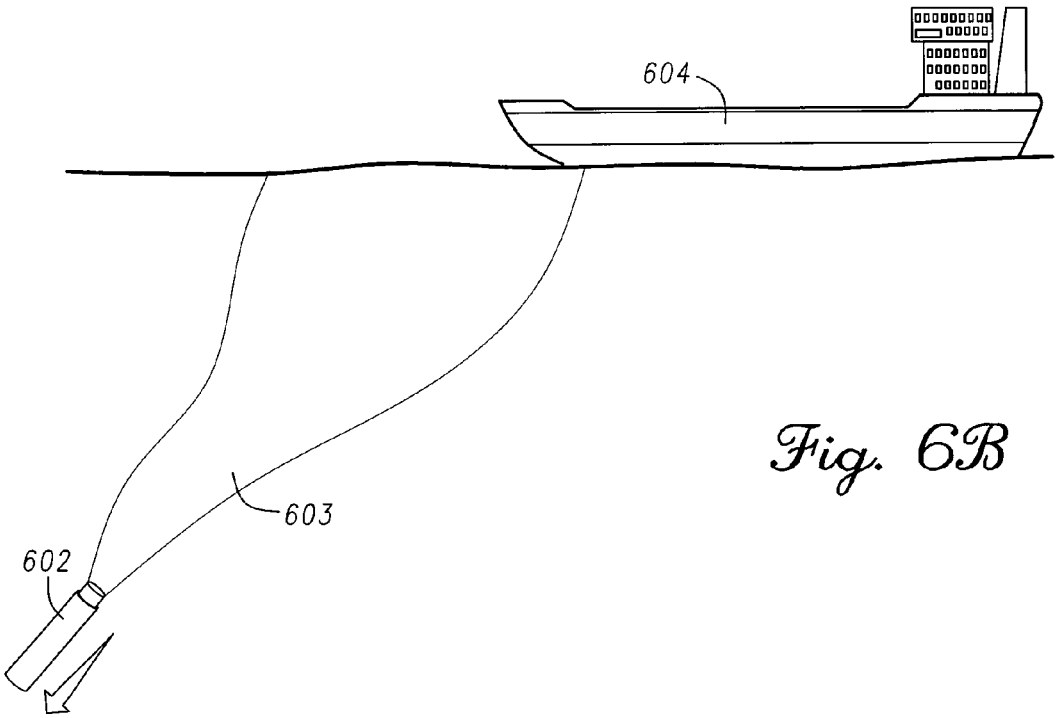
Figure 6C:
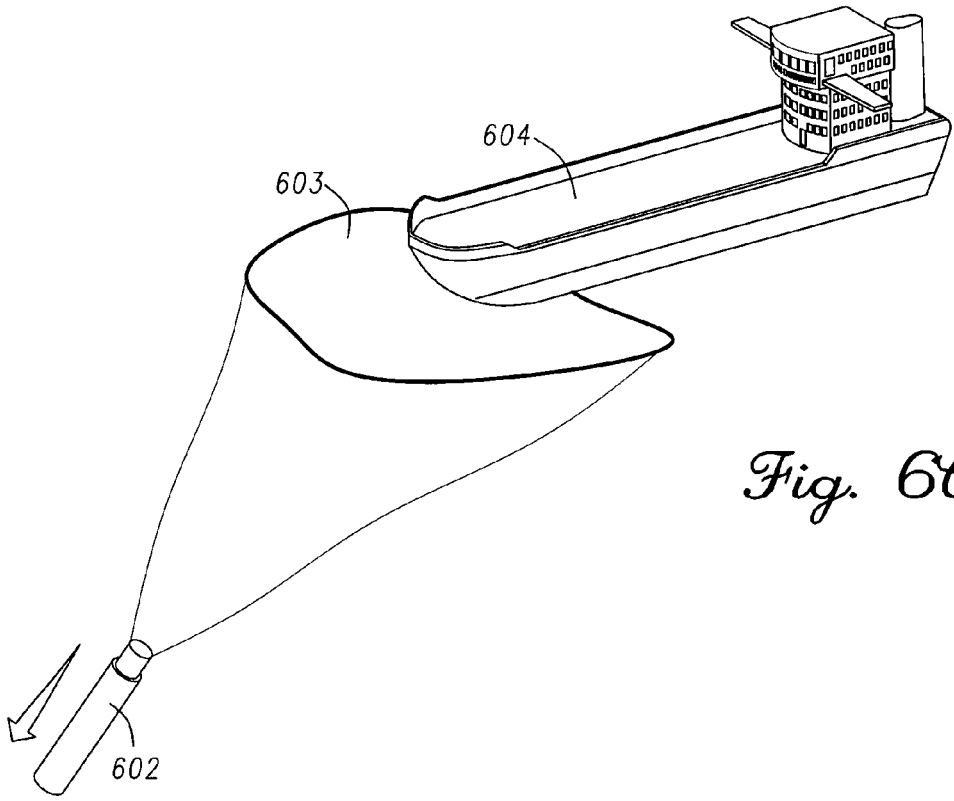
Figure 6D:
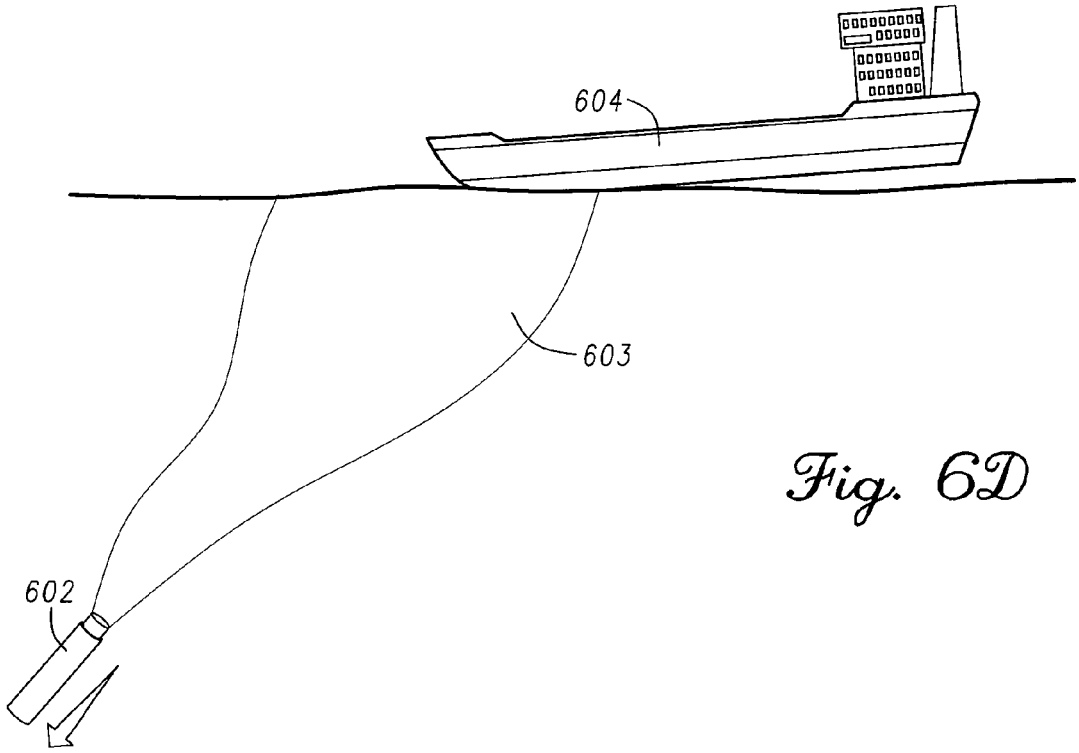

In some embodiments, to stop an errant closed cabin vessel, one or more bubble weapons may be configured to cause the moving vessel 604 to pitch down, driving the bow into the water. As illustrated in FIG. 6D, the stern of the moving vessel 604 may rise, taking the propellers out of the water and effectively stopping the moving vessel 604.

Figure 6E:
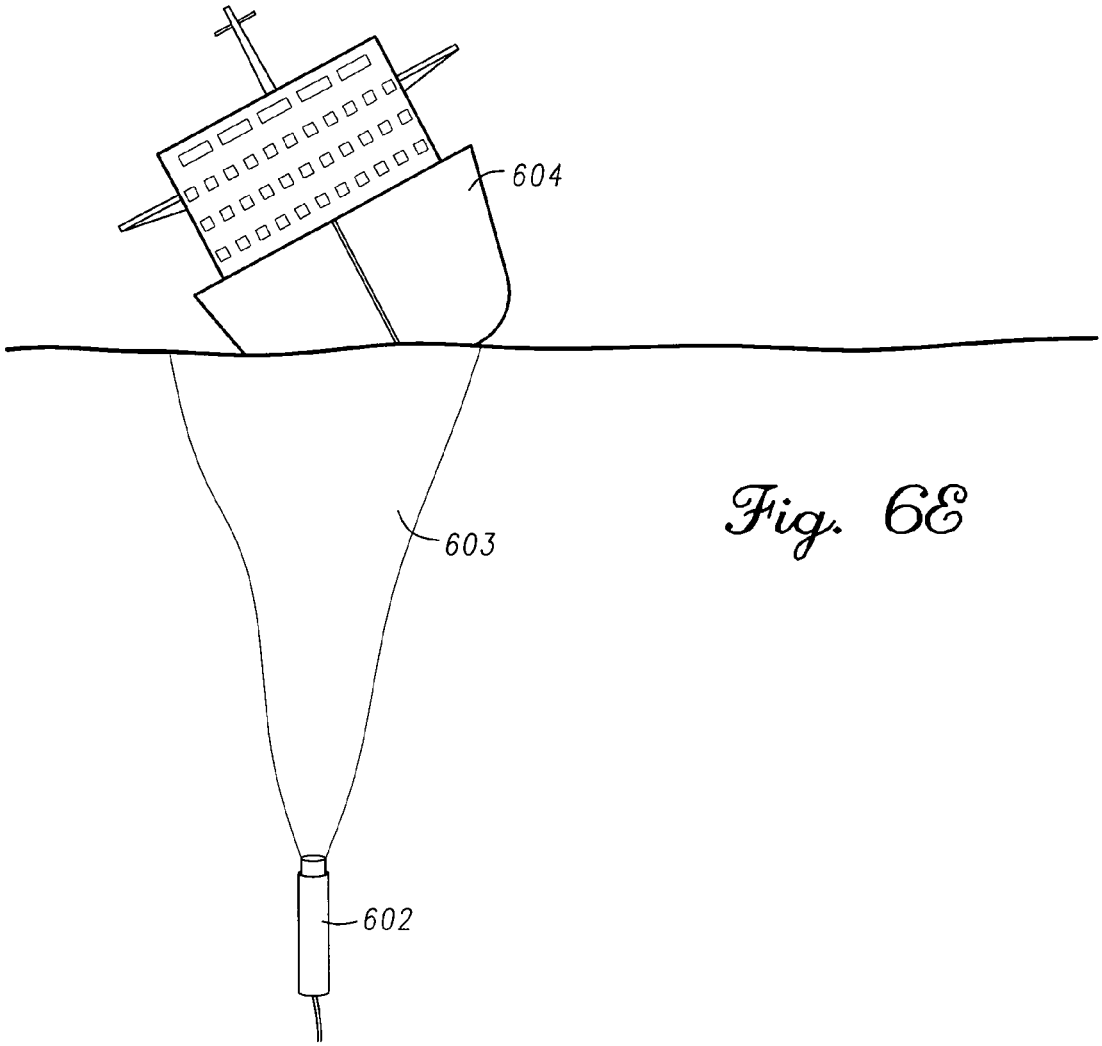

In the embodiments illustrated in FIG. 6E, greater positional resolution may be employed to cause the same effects laterally and cause the moving vessel 604 to list. A combination of pitching down and listing may be employed to force the center of mass out of the boundary of the vessel's moment of buoyancy to keel over the vessel 604. Once the buoyancy of the water is restored, the capsized vessel may surface. After this action, the vessel 604 may be keel up and floating. Accordingly, a less-than-lethal method of stopping a large, closed cabin vessel is provided.

Figure 7A:
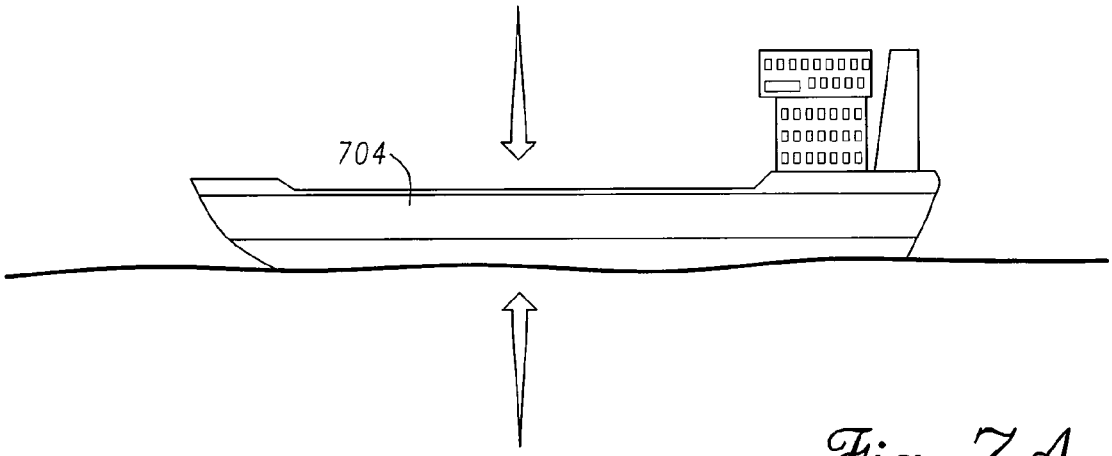
FIGS. 7A and 7B illustrate keel breaking by one or more bubble weapons, in accordance with some embodiments.
Figure 7B:
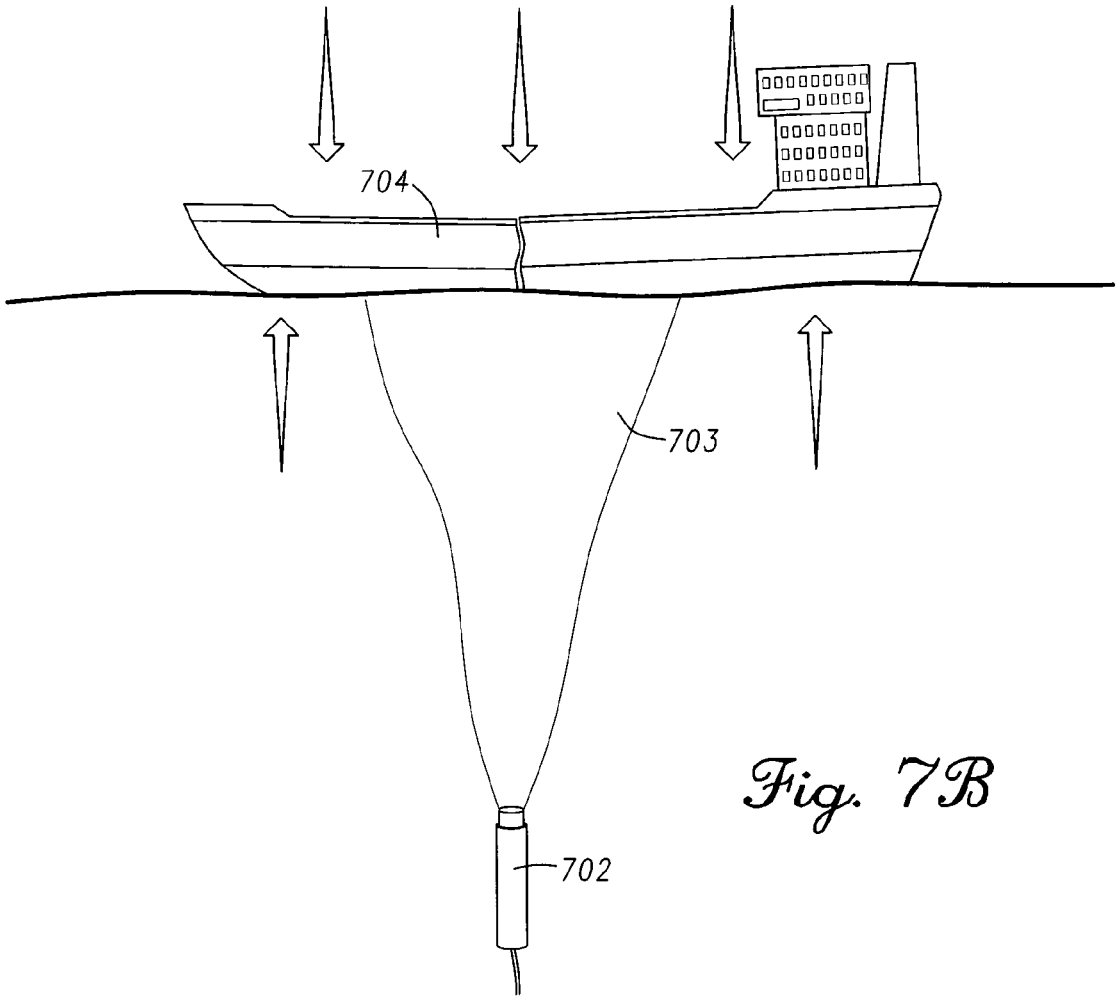

FIGS. 7A and 7B illustrate keel breaking by one or more bubble weapons, in accordance with some embodiments. In these embodiments, a system of one or more bubble weapons 702 may be configured to generate a plume 703 directly under a central portion of a vessel 704 to reduce the buoyancy of water below the central portion in order to break a keel of the vessel 704. In these embodiments, the reduction in buoyancy of the water under the central portion of the vessel's keel may break the keel of the vessel 704 because buoyancy remains at the bow and the stern. Many bulk carriers and tankers do not have the longitudinal strength to withstand more than a few degrees of pitch out of the water. In these embodiments, the configurable diffuser section may be configured in either the thrust-engaged configuration or the thrust-neutral configuration depending on the target.

Figure 8:
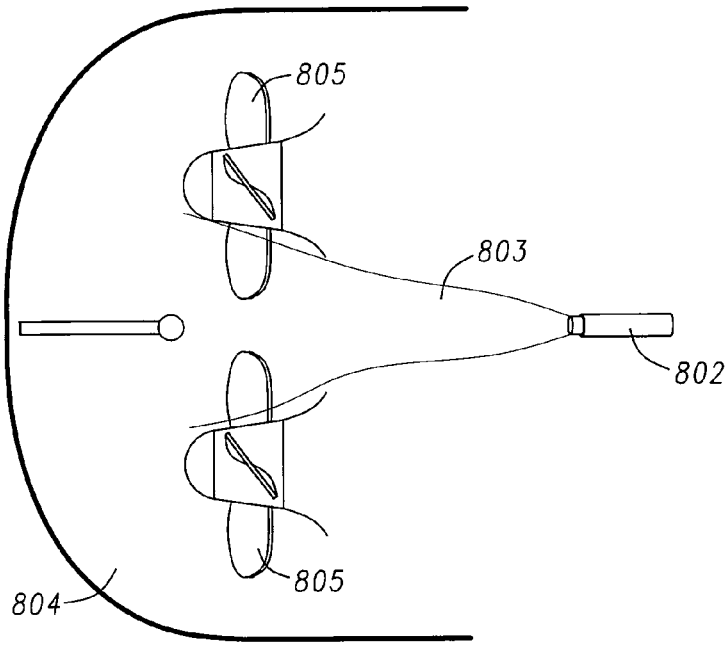
FIG. 8 illustrates disruption of a vessel by cavitation by one or more bubble weapons, in accordance with some embodiments.

FIG. 8 illustrates disruption of a vessel by cavitation by one or more bubble weapons, in accordance with some embodiments. In these embodiments, one or more bubble weapons 802 may be configured to generate a plume 803 in front of a propeller 805 of a moving vessel 804. The plume 803 may be configured to be streamlined into a flow field of the propeller 805 to cause cavitation to reduce thrust. When a propeller 805 intakes bubbles, a lower density fluid reduces the maximum power coupling to the water from the power train. The change in density of the fluid would be in practice 500-1000 times lower. The mass of fluid that is opposing the propeller's rotation will effectively drop by a factor of 500-1000.

In these embodiments, a sudden and dramatic loss of counter force on the vessel's propulsion system would result in several effects. It may reduce overall thrust and power output, slowing the vessel. Loss of coupling may also over rev the engines forcing the power train to reduce output or risk over speeding the engine and possibly destroying it. For many large vessels, powering down and then returning to full power requires a significant period of hysteresis. For many vessels, a rapid loss of power may damage the power train.

In some embodiments, the one or more bubble weapons 802 may be configured to generate a pulsed-bubble plume that is streamed into the propeller 805. In these embodiments, the pulsed-bubble plume may cause a hammering effect to the propellers and drive train that would compel any reasonable engineer to shut down power to avoid catastrophic failure.

When a bubble plume asymmetrically flows into a propeller, a torque, pivoting about the asymmetric axis, is applied to the propeller 805. The difference in forces on one side of the propeller 805 versus the other will be between 500-1000 times. This torque may be tremendous and it may be applied in a vector that the propeller shaft and bearings are not designed for, which may tend to shear off the propeller from its shaft. If the propeller 805 survives this attack, the asymmetric load on the propeller may cause a further hammering effect on the propeller. Each time a propeller blade leaves and enters the bubble stream, the differential loading may hammer the propeller and the synergy of these forces may damage the propeller shaft and bearings or force a quick shutdown of the engine.

In some embodiments, the system may be configured to neutralize a vessel's thrust without damaging the power train by throttling the bubble weapons output. This may allow the power system of the vessel 804 to slowly accelerate into an over-speed condition and reduce the thrust of the vessel 804.

In some embodiments, these effects may be applied to make the thrust of the vessel 804 asymmetric. On multi-propeller ships, one propeller can be bubbleized which may cause the other propeller to generate greater thrust, causing the vessel 804 to turn away from the higher thrust propeller. On single propeller vessels, bubbles may be throttled into one side of the propeller, causing an unperturbed side of the propeller to have greater thrust. In these embodiments illustrated in FIG. 8, the configurable diffuser section may be configured in either the thrust-engaged configuration or the thrust-neutral configuration depending on the target.

In some embodiments, one or more bubble weapons may be configured to generate the plume of bubbles under a sonar transducer of the vessel 804 to disrupt a sonar power output of the sonar transducer. In these embodiments, the configurable diffuser section may be configured in either the thrust-engaged configuration or the thrust-neutral configuration depending on the target. In these embodiments, a bubble weapon 802 may be deployed so that the bubble plume may come into physical contact with a vessel's sonar transducer. When the acoustic power from the transducer into the water is disrupted, the output power from the transducer may not flow as efficiently from the transducer into the surrounding water. If this energy remains within the transducer, the transducer may be shut off or destroyed. In some embodiments, when bubbles are released slowly over time, a low density of bubbles may cause refractive disruptions of the transducer water interface. This refractive discontinuity may cause phase deviations and spectral dispersions of the sonar waves, thus increasing the noise of the system.

Figure 9A:
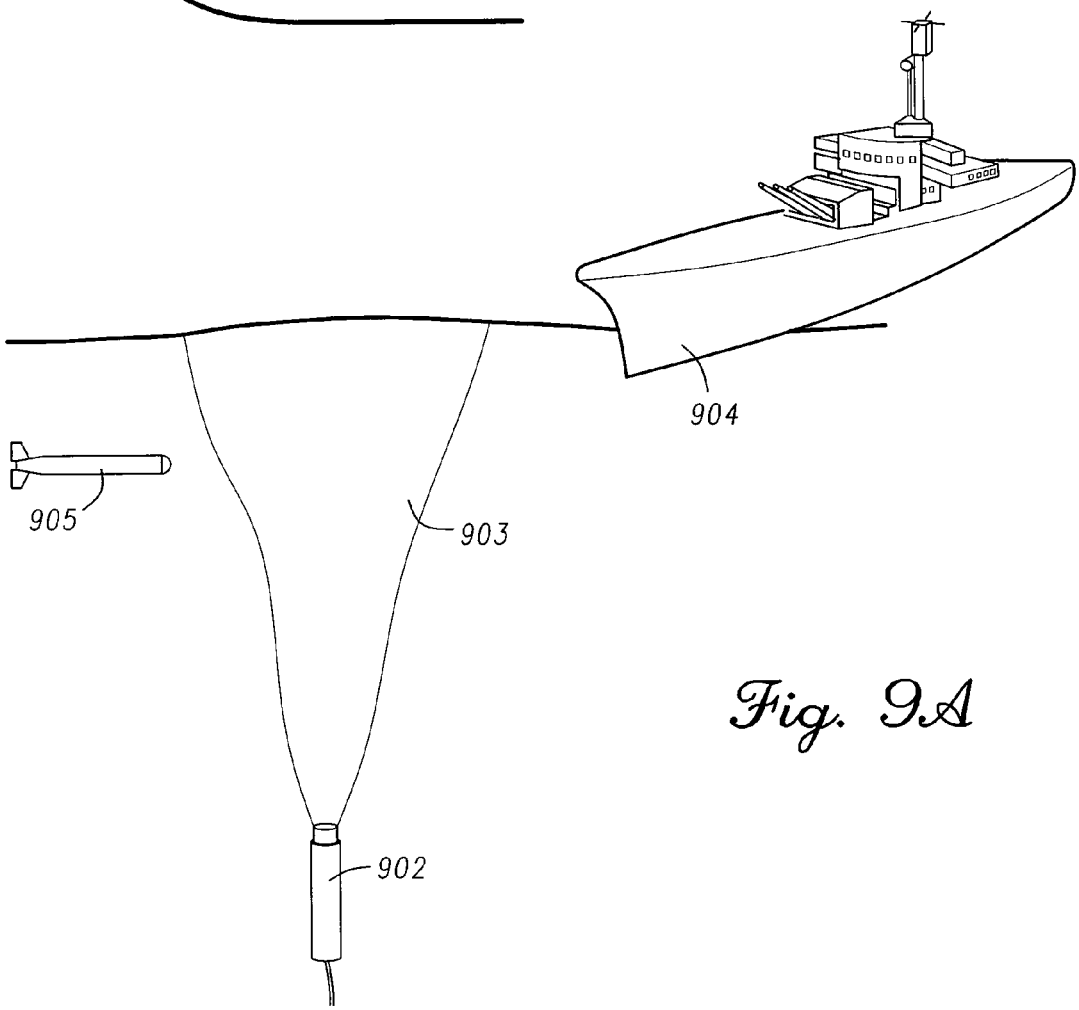
FIGS. 9A, 9B and 9C illustrate a torpedo defense system comprising one or more bubble weapons, in accordance with some embodiments.
Figure 9B:
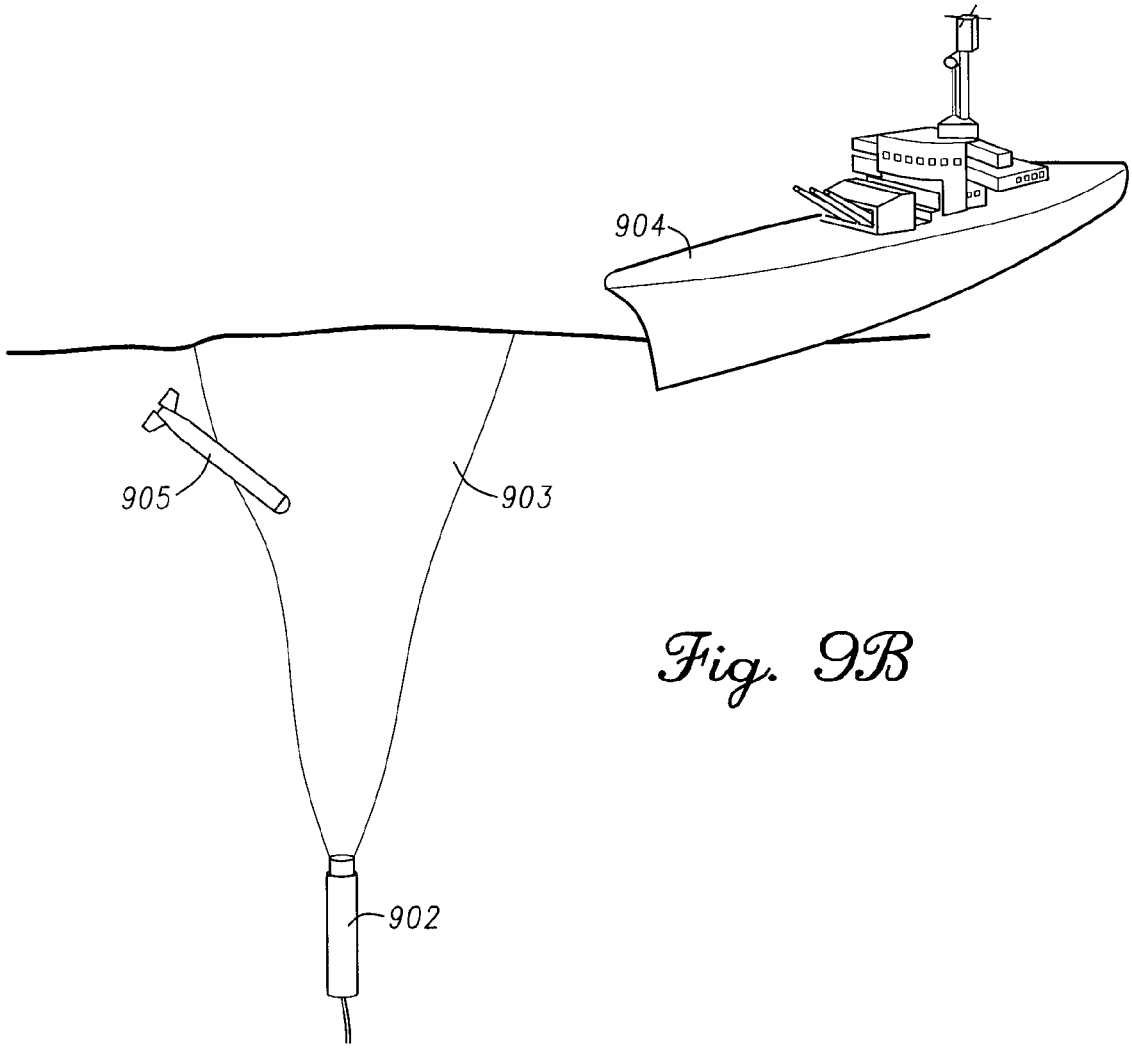
Figure 9C:
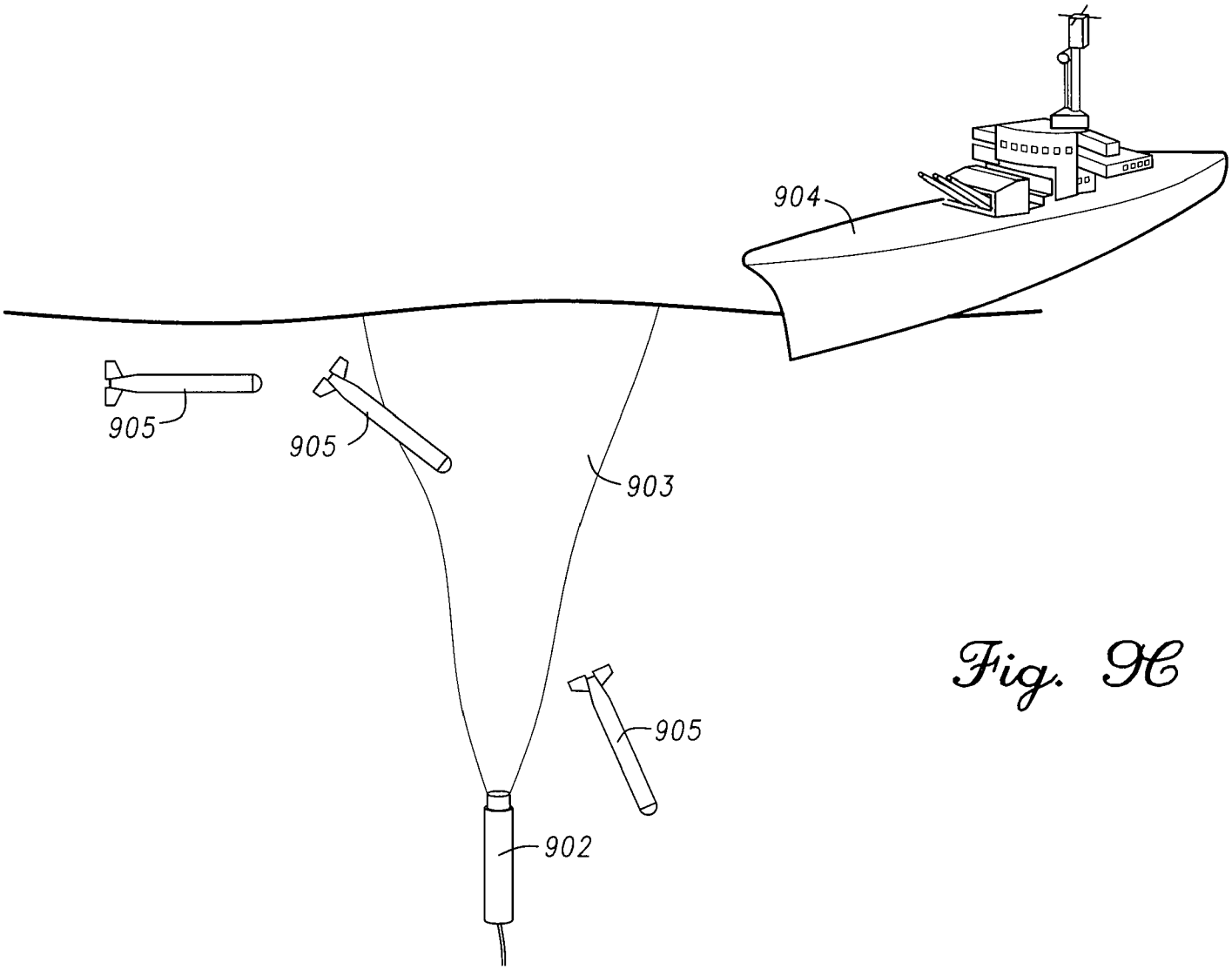

FIGS. 9A, 9B and 9C illustrate a torpedo defense system comprising one or more bubble weapons, in accordance with some embodiments. In these embodiments, a bubble weapon system comprising one or more bubble weapons 902 may be configured to generate a bubble plume 903 in a path of a torpedo 905. The bubble plume 903 may disrupt buoyancy of the water and cause the torpedo 905 to be directed away from a vessel 904 that is being protected.

As illustrated in FIG. 9A, a torpedo 905 enters the bubble plume 903. In FIG. 9B, the torpedo falls into the bubble plume 903 and looses thrust and control. In these embodiments, a control system on the vessel 904 may cause the bubble weapon 902 to discharge and generate the bubble plume 903 based on detection of the torpedo 905 and based on a position of the torpedo 905.

A torpedo is generally neutrally buoyant in water, but it is not neutrally buoyant when in the bubble plume 903. Several effects will occur when the bubble plume 903 is released ahead of a torpedo. As illustrated in FIG. 9C, first the torpedo 905 may pitch down, pointing the unit to the seafloor. With buoyancy lost, the torpedo may fall into the bubble plume because the bubbleized water will virtually eliminate the thrust of the torpedo 905. The control surfaces may also lose effectiveness in the low density water and make the torpedo unrecoverable. In these embodiments, the guidance and navigation of the torpedo 905 will also be lost. The torpedo 905 may also lose sonar driven guidance since the water is no longer transparent to sonar signals. Galvanometers may also be disoriented because a large magnetic field surrounds the plume. The rapid change in orientation of the torpedo 905 may be much greater than the design limit of the torpedo's guidance systems. The electromagnetic effect of the bubble plume 903 may also create a magnetic circulation around the bubble stream. Since the water is paramagnetic, large amounts of noise may be added to a Gaussian detection system of the torpedo 905.

As further illustrated in FIG. 9C, one or more of these effects may be acting upon the torpedo 905 when it exits the bubble plume. As a result, the torpedo 905 may be heading oriented to the seafloor and have a motion vector that is dramatically different than its heading vector. The torpedo 905 may be unable to recover from the sonar disruption or loss, geo-magnetically disorientation, and power train failures, and may receive a mechanical shock when it re-enters normal water. Furthermore, if the torpedo 905 is able to pass-through the plume 903, it may be pitched down when it exits the plume and be longer pointing to the target vessel 904.

In some embodiments, the system of one or more bubble weapons 902 may be configured to provide a defense against high speed cavitating torpedoes. Since bubbleized water has a greatly different density than the surrounding water, when the cavitating torpedo hits this water, the displacement drag of the weapon may drop proportionally (e.g., 500-1000 times). This may cause a dramatic acceleration in the torpedo. When the torpedo 905 passes through the bubble plume 903, it will have a directly proportional deceleration. Given the short time of transit through the bubble plume, a hammering effect upon the torpedo 905 may result. This impulse may be great enough to damage the structure of the torpedo 905, which may also damage gyros and navigation systems of the torpedo 905.

In these embodiments illustrated in FIGS. 9A-9C, the configurable diffuser section may be configured in either the thrust-engaged configuration or the thrust-neutral configuration, depending on the target.

Figure 10:
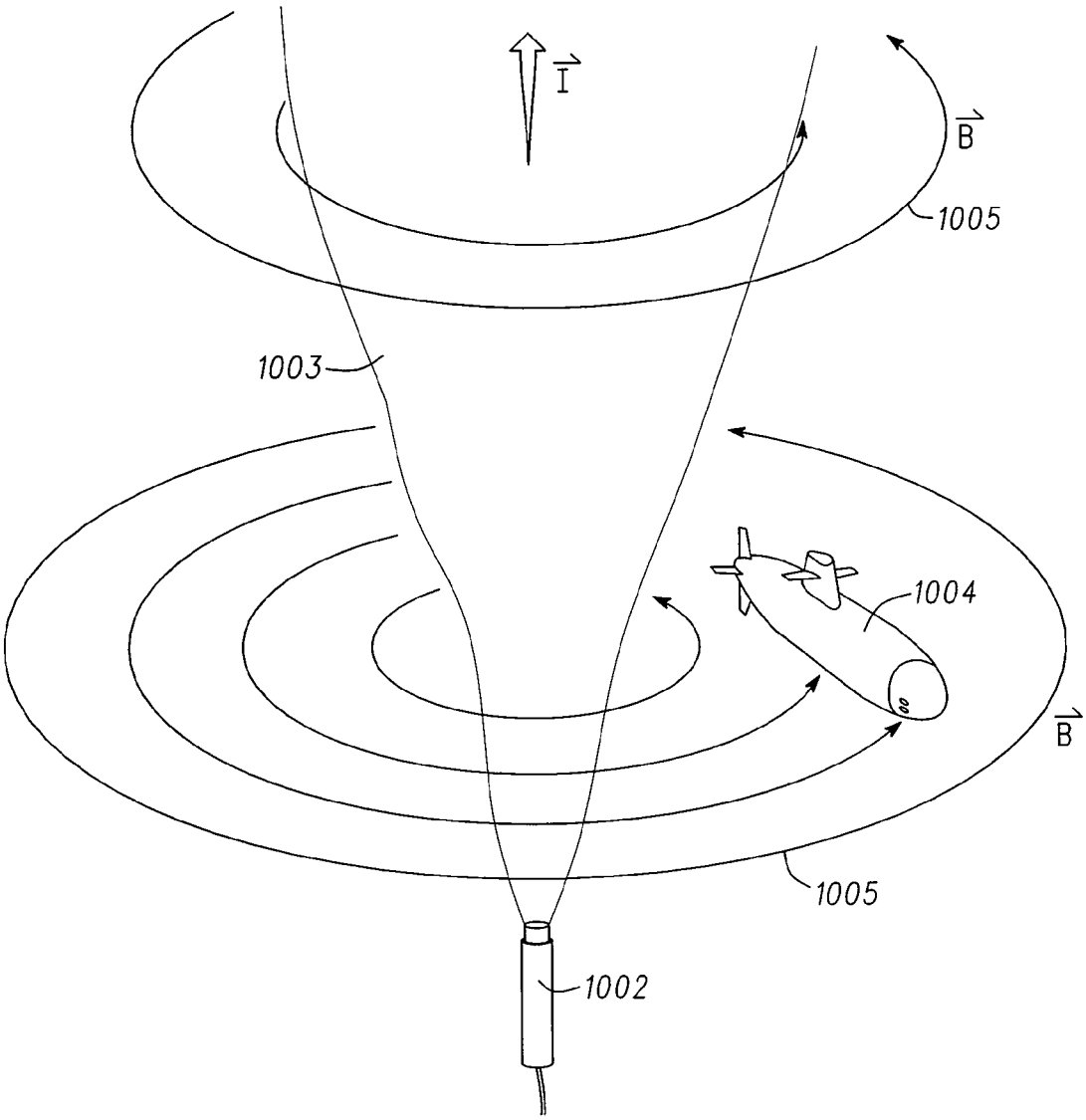
FIG. 10 illustrates generation of a magnetic field using one or more bubble weapons, in accordance with some embodiments.

FIG. 10 illustrates generation of a magnetic field using one or more bubble weapons, in accordance with some embodiments. In these embodiments, one or more bubble weapons 1002 may be configured to generate a bubble plume 1003 comprising a non-conductive gas. The bubbles of the plume 1003 may generate a static charge as the bubbles rise through the water, resulting in a magnetic field 1005 circulating around the bubble plume 1003. In these embodiments, the bubble plume 1003 may be positioned to either magnetize a vessel 1004 with the magnetic field 1005 or disrupt electronic warfare operations.

In these embodiments, the bubbles emitted from the bubble weapon 1002 may comprise a non-conductive gas such as carbon dioxide. Since the water is conductive, when the non-conductive gas slides through the water, a static charge may build up that rises with the bubbles of the plume 1003. The motion of the charge may be viewed as current resulting in the magnetic field 1005 that is circulating around the bubble plume 1003 (i.e., per the right-hand rule). The magnetic field 1005 may be utilized for naval purposes. For example, the magnetic field 1005 may be used to jam or confuse various electronic warfare operations as it may affect circuits that are not shielded in a Faraday cage. The magnetic field 1005 may also be used to magnetize the hull of an enemy ship, such as vessel 1004. Once a ship's hull has been magnetized, it may be more easily identified by common galvanometer techniques. To eliminate the magnetic signature on the vessel 1004, the vessel 1004 may need to return to port and undergo an extensive and expensive degaussing procedure. In these embodiments illustrated in FIG. 10, the configurable diffuser section may be configured in either the thrust-engaged configuration or the thrust-neutral configuration depending on the target.

Figure 11:
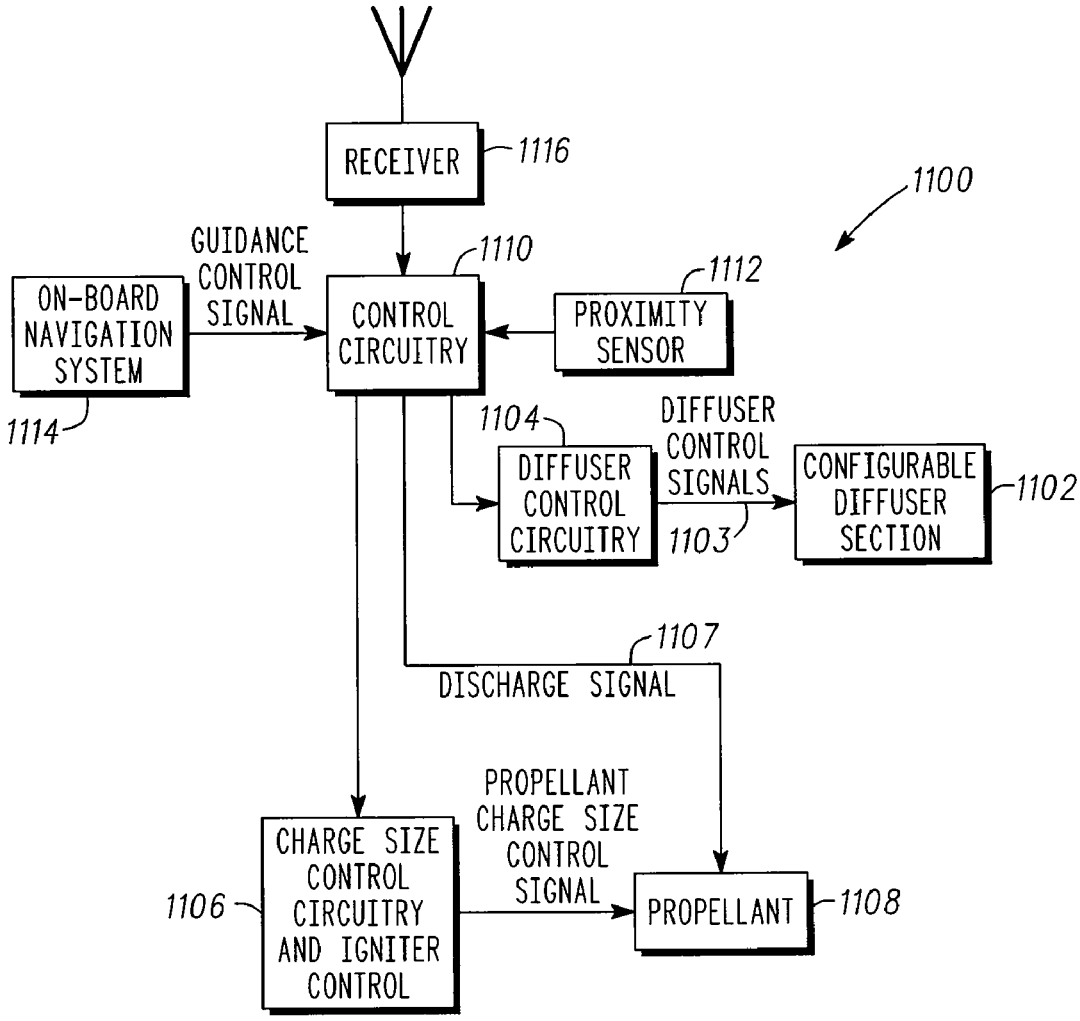
FIG. 11 illustrates a functional block diagram of a bubble weapon, in accordance with some embodiments.

FIG. 11 illustrates a functional block diagram of a bubble weapon, in accordance with some embodiments. Bubble weapon 1100 may be suitable for use as any one or more of the bubble weapons described herein. In these embodiments, the bubble weapon 1100 may comprise a configurable diffuser section 1102 and diffuser control circuitry 1104. The diffuser control circuitry 1104 may provide diffuser control signals 1103 to configure the configurable diffuser section 1102 to operate in either a thrust-engaged configuration or a thrust-neutral configuration. When configured to operate in the thrust-neutral configuration, the diffuser section 1102 is configured to generate a neutral thrust when generating a bubble plume in order to keep the bubble weapon 1100 in a stationary location. When configured to operate in the thrust-engaged configuration, the diffuser section 1102 is configured to generate a predetermined amount of thrust when generating a bubble plume in order to propel the bubble weapon 1100 through water.

In some embodiments, the configurable diffuser section 1102 may be further configurable by the diffuser control circuitry 1104 to generate spin to spin-stabilize the bubble weapon, configured for generating a predetermined size of the bubbles of the bubble plume, and configured for generating a streaming plume by varying a rate of bubble generation. In these embodiments, diffuser control circuitry 1104 may be configured to control the reaction pressure within the reaction chamber to control the burn rate of the propellant 1108. In these embodiments, the amount of thrust, the amount of spin, the size of the bubbles, the size of the bubble plume and the rate of bubbles of the streaming plume may be varied by the configurable diffuser section 1102.

In some embodiments, the bubble weapon 1100 may also include propellant charge-size control circuitry 1106 to vary a charge size to control an amount of the propellant 1108 that is ignited in order to vary an amount of gas generated when generating the bubble plume. In some embodiments, the bubble weapon 1100 may also include control circuitry 1110 to control the operations of the bubble weapon 1100. In some embodiments, the bubble weapon 1100 may also include one or more optional proximity sensors 1112 to detect the proximity of a vessel for detonation or intelligence. In some embodiments, the bubble weapon 1100 may also include an on-board navigation system 1114 and its accompanying sensors for use in navigating the bubble weapon 1100 through water. In some embodiments, the bubble weapon 1100 may also include a wireless or wired receiver 1116 for receiving command and control signals. In some embodiments, the bubble weapon 1100 may also include a transceiver, to transmit images, location or other data.

In response to a discharge signal 1107, the propellant 1108 may be ignited within a pressure vessel section and discharged into the configurable diffuser section 1102 to generate an expanding gas bubble or a bubble plume. In some embodiments, the discharge signal 1107 may ignite a selected portion of the propellant 1108 to control the amount of gas that is generated. The size and the type of the expanding gas bubble or bubble plume may be based on the configuration selected for the configurable diffuser section 1102 as well as the amount of propellant 1108 that is selected. The configurable diffuser section 1102 may also be configured to utilize the energy of the ejected gas to thrust the weapon for navigation.

In some other embodiments, one or more bubble weapons 1100 may be configured for anoxic pressure discharge into a large volume. In these embodiments, a bubble weapon 1100 may be positioned near an air-intake of an engine of an errant vessel and may discharge an anoxic gas. The anoxic gas may cause the engine to stall. The discharge rate of the gas may be selected based on the engine. In these embodiments, the configurable diffuser section 1102 may be configured in the thrust-neutral configuration. In these embodiments, a bubble weapon 1100 may be used as a source of high-pressure high-volume gas. This gas may be carbon-dioxide and other trace reaction products. In these embodiments, the bubble weapon 1100 may be placed in the intake of an errant ship. Placement may be by means of a delivery vehicle or by special troops. Discharged, the anoxic gas may quench the engine. The discharge rate of the bubble weapon may be adjusted for the capacity and type of target engine.

In some other embodiments, a bubble weapon 1100 may be deployed inside a vessel. A burst deployment of the bubble weapon 1100 very rapidly raises the barometric pressure inside the vessel, which may disable the crew and the ship's systems. Pressure operated systems on the vessel may go into a failure mode because reference pressures went well out of limits. The build-up in pressure within the vessel may cause other effects to the hull, such as blowing out windows and doors and/or blowouts of hull walls. In these embodiments, because the bubble weapon's gasses are anoxic, the bubble weapon 1100 can be used as an emergency fire extinguisher. The bubble weapon 1100 may also be detonated to drive out atmosphere from a ship's volume to quench a fire. It may also be connected to plumbed fire extinguishing systems as spare sources. In the event of a sinking, the weapon can be discharged into a water-tight section of the vessel to displace encroaching water.

In some embodiments, the buoyancy dissipater described in the US patent application, entitled "BUOYANCY DISSIPATER AND METHOD TO DETER AN ERRANT VESSEL" filed Jan. 30, 2009 having Ser. No. 12/362,547 and which is incorporated herein by reference, may be suitable for use as any one of the bubble weapons described herein. In some embodiments, the configurable diffuser described in patent application entitled "VORTICE AMPLIFIED DIFFUSER FOR BUOYANCY DISSIPATER AND METHOD FOR SELECTABLE DIFFUSION" filed concurrently herewith and which is incorporated herein by reference may be suitable for use as the configurable diffuser section 1102.

The Abstract is provided to comply with 37 C.F.R. Section 1.72(b requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A bubble weapon system comprising:

two or more bubble weapons, wherein each bubble weapon comprises a diffuser section to generate a plume of bubbles in water and control a size of the plume, the size of the plume being selected to reduce buoyancy of the water to inhibit movement of a vessel or disrupt operations of the vessel;

the system including processing circuitry configured to:

receive inputs including information related to a traveling vector of the vessel and a length of the vessel;

calculate a plume size for each of the bubble weapons based on the traveling vector and the length; and cause the bubble weapons to:

release a large plume asymmetric to the traveling vector of the vessel, the large plume based on the calculated plume size and being greater than half the length of the vessel; or generate a ribbon plume based on the calculated plume size that traverses the traveling vector of the vessel at an angle that ranges between thirty and sixty degrees, wherein the large plume or the ribbon plume is calculated by the processing circuitry to cause the vessel to capsize as the vessel enters the plume.

2. The system of claim 1, wherein the one or more bubble weapons are configured to selectively submerge either bow or stern of the vessel.

3. The system of claim 1, wherein the bubble weapon system is configured for fixed asset protection, the system comprising a tethered array of bubble weapons, each bubble weapon being stationed at a fixed location.

4. The system of claim 3, wherein each bubble weapon includes a proximity sensor to sense a vessel and discharge under the vessel based on the vessel's proximity.

5. The system of claim 3, wherein the bubble weapons of the array are signaled to discharge by a control signal provided by a system controller external to the bubble weapons.

6. The system of claim 1, wherein the one or more bubble weapons are configured for asymmetric loading of a moving vessel, wherein the one or more bubble weapons include a diffuser configurable to create thrust to propel the bubble weapon and configurable to generate a bubble plume, wherein the diffuser is configured to:

generate the bubble plume below a bow of the moving vessel; and propel the bubble weapon while generating the bubble plume to extend the bubble plume in a direction of the moving vessel's momentum causing the moving vessel to pitch and roll over.

7. The system of claim 1, wherein the one or more bubble weapons are configured to generate the plume directly under a central portion of the vessel to reduce buoyancy of water under the central portion to break a keel of the vessel.

8. The system of claim 1, wherein the one or more bubble weapons are configured to generate a plume in front of a propeller of a moving vessel, wherein the plume is configured to be streamlined into a flow field of the propeller to cause cavitation to reduce thrust.

9. The system of claim 8, wherein the one or more bubble weapons are further configured to generate a pulsed bubble plume that is streamed into the propeller.

10. The system of claim 1, wherein the one or more bubble weapons are configured to generate the plume of bubbles under a sonar transducer of the vessel to disrupt sonar power output of the sonar transducer.

11. The system of claim 1, wherein the one or more bubble weapons are configured to generate a bubble plume comprising a non-conductive gas, wherein bubbles of the plume are configured to generate a static charge as the bubbles rise through the water, resulting in a magnetic field circulating around the bubble plume; and wherein the bubble plume is positioned to either magnetize the vessel with the magnetic field or disrupt electronic warfare operations.

12. A bubble weapon system comprising:

one or more bubble weapons, wherein each bubble weapon comprises a configurable diffuser section and diffuser control circuitry to generate a plume of bubbles in water and control a size of the plume, the size of the plume being selected to reduce buoyancy of the water to inhibit movement of a vessel or disrupt operations of the vessel;

wherein the diffuser control circuitry provides diffuser control signals to configure the configurable diffuser section to operate in either a thrust-engaged configuration or a thrust-neutral configuration, wherein when configured to operate in the thrust-neutral configuration, the diffuser section is configured to generate a neutral thrust when generating a bubble plume to keep the bubble weapon in a stationary location, and wherein when configured to operate in the thrust-engaged configuration, the diffuser section is configured to generate a predetermined amount of thrust when generating the bubble plume to propel the bubble weapon through water.

13. The system of claim 12, wherein the configurable diffuser section is further configurable by the diffuser control circuitry to generate one or more of:

a spin to spin-stabilize the bubble weapon;

a predetermined size of the bubbles of the bubble plume;

a predetermined size of the bubble plume; and a streaming plume by varying a rate of bubble generation.

14. The system of claim 13, wherein each of the bubble weapons further comprises propellant charge-size control circuitry to vary a charge size to control an amount of propellant that is ignited to vary an amount of gas generated when generating the bubble plume.

15. A bubble weapon system including one or more bubble weapons, the one or more bubble weapons comprising:

a pressure vessel section containing a propellant, and a diffuser coupled with an exterior of the pressure vessel section, the diffuser configured to generate a plume of bubbles, the diffuser directing the plume of bubbles exterior to the one or more bubble weapons in a plume generating configuration;

the bubble weapon system including diffuser control circuitry configured to control a size of the plume of bubbles with the diffuser; and in a pre-plume configuration, the propellant is stored within the pressure vessel, and an exterior surface of the pressure vessel of the bubble weapon is configured for placement within an open body of liquid, and in the plume generating configuration, the propellant generates the gas and the diffuser generates the plume of bubbles with the gas, the diffuser generates an unrestrained plume of bubbles within the open body of liquid.

16. The system of claim 15, wherein the one or more bubble weapons are configured to generate a sonar and acoustic-opaque barrier to cause sonar blindness, wherein to generate the sonar and acoustic-opaque barrier, the one or more bubble weapons are to generate the plume of bubbles by releasing bubbles in a slow manner over a period of time.

17. The system of claim 15, wherein the one or more bubble weapons are configured to generate the plume of bubbles in a path of a torpedo, wherein the plume of bubbles is configured to disrupt buoyancy of the water and cause the torpedo to be directed away from a vessel that is being protected.

18. The system of claim 15, wherein the diffuser of at least one of the one or more bubble weapons is configurable by the diffuser control circuitry to generate one or more of:

a spin to spin-stabilize the one or more bubble weapons;

a predetermined size of bubbles of the plume of bubbles; and a streaming plume by varying a rate of bubble generation.

19. The system of claim 15 comprising propellant charge-size control circuitry, wherein the propellant charge-size control circuitry is configured to vary a charge size of the propellant to control an amount of the propellant ignited to according vary an amount of gas generated for the plume of bubbles.

20. The system of claim 15, wherein the one or more bubble weapons are configured to selectively submerge either bow or stern of the vessel.

21. The system of claim 15, wherein the bubble weapon system is configured for fixed asset protection, the one or more bubble weapons include a tethered array of bubble weapons, each bubble weapon is stationed at a static location.

22. The system of claim 15 comprising a proximity sensor configured to sense a vessel and generate the plume of bubbles under the vessel based on the vessel proximity.

23. The system of claim 15, wherein the one or more bubble weapons are configured for asymmetric loading of a moving vessel, the diffuser of one or more of the bubble weapons is configurable to:

generate the plume of bubbles below a bow of the moving vessel; and propel the bubble weapon while generating the plume of bubbles to extend the plume of bubbles in a direction of the momentum of the moving vessel to cause one or more of pitching and rolling over of the moving vessel.

24. The system of claim 15, wherein the one or more bubble weapons are configured to generate the plume of bubbles in front of a propeller of a moving vessel, wherein the plume of bubbles is configured to be streamlined into a flow field of the propeller to cause cavitation to reduce thrust.

25. The system of claim 24, wherein the one or more bubble weapons are configured to generate a pulsed plume of bubbles streamed into the propeller.

* * * * *

UNITED STATES PATENT AND TRADEMARK OFFICE

CERTIFICATE OF CORRECTION

PATENT NO. : 8,371,204 B2
APPLICATION NO. : 12/770890
DATED : February 12, 2013
INVENTOR(S) : Elder et al.

It is certified that error appears in the above-identified patent and that said Letters Patent is hereby corrected as shown below:

On the title page

On page 2, in column 1, item 56 under "Other Publications", line 5, delete "Adivosry" and insert --Advisory--, therefor On page 2, in column 2, item 56 under "Other Publications", line 10, delete "2010." and insert --2010--, therefor On page 2, in column 2, item 56 under "Other Publications", line 11, after "12/698,611", insert --,--, therefor On page 2, in column 2, item 56 under "Other Publications", line 13, before "U.S.", insert --"--, therefor On page 2, in column 2, item 56 under "Other Publications", line 14-15, after "Diffusion", insert --"--, therefor In the specification In column 4, line 43, before second occurrence of "a", insert --by--, therefor In column 5, line 27, delete "weapons*" and insert --weapons--, therefor In column 7, line 20, delete "weapons" and insert --weapon's--, therefor In column 7, line 42, delete "into" and insert --in--, therefor In column 8, line 28, delete "geo-magnetically" and insert --geo-magnetic--, therefor Signed and Sealed this
Thirty-first Day of May, 2016

Michelle K. Lee

Michelle K. Lee
*Director of the United States Patent and Trademark Office*

In the specification

In column 8, line 31, delete “pass-through” and insert --pass through--, therefor In column 9, line 2, before “per”, insert --as--, therefor In column 10, line 61, delete “1.72(b” and insert --1.72(b)--, therefor In the claims In column 13, line 23, in Claim 19, delete “according” and insert --accordingly--, therefor